US009779707B2

(12) United States Patent
Turner

(10) Patent No.: US 9,779,707 B2
(45) Date of Patent: Oct. 3, 2017

(54) THIGH DRUM

(71) Applicant: Karen Turner, Austin, TX (US)

(72) Inventor: Karen Turner, Austin, TX (US)

( * ) Notice: Subject to any disclaimer, the term of this patent is extended or adjusted under 35 U.S.C. 154(b) by 0 days.

(21) Appl. No.: 15/237,397

(22) Filed: Aug. 15, 2016

(65) Prior Publication Data

US 2017/0040007 A1 Feb. 9, 2017

Related U.S. Application Data

(62) Division of application No. 29/502,889, filed on Sep. 19, 2014, now Pat. No. Des. 763,952.

(51) Int. Cl.
*G10G 5/00* (2006.01)
*G10D 13/02* (2006.01)

(52) U.S. Cl.
CPC ..... *G10G 5/005* (2013.01); *G10D 13/028* (2013.01)

(58) Field of Classification Search
CPC .... G10D 13/026; G10D 13/00; G10D 13/023; G10D 13/028; G10G 5/00; Y10T 29/49574; Y10T 403/7062; Y10T 156/10; Y10T 403/32418; Y10T 403/32426; Y10T 403/32467; Y10T 403/32532; Y10T 403/45
See application file for complete search history.

(56) References Cited

U.S. PATENT DOCUMENTS 114,636 A 5/1871 Beach
1,284,526 A 11/1918 Winne
2,338,816 A 1/1944 Lockhart
2,475,873 A 7/1949 Banta
2,565,225 A 8/1951 Gladstone
3,166,970 A 1/1965 Ellman
3,955,461 A 5/1976 Ivie
3,979,993 A 9/1976 Proctor
D254,140 S 2/1980 Kuipers
4,214,504 A 7/1980 Rex
D257,989 S 1/1981 Ludwig
4,387,531 A 6/1983 Jacob
4,406,207 A * 9/1983 Criscione ..... G10D 13/029 84/411 P
4,409,861 A 10/1983 Sakurai
4,441,398 A 4/1984 Baker
4,520,709 A 6/1985 Kester
4,566,365 A 1/1986 Huston
(Continued)

FOREIGN PATENT DOCUMENTS

CN 202816338 U 3/2013
DE 8815749 U1 4/1989
(Continued)

OTHER PUBLICATIONS http://www/musiciamsfriend.com/drums-percussion/remo-tar-frame-drum/h14080000002002, Remo Tar Fram Drum, Last access Apr. 12, 2014.

(Continued)

*Primary Examiner* — Kimberly Lockett
(74) *Attorney, Agent, or Firm* — Scheinberg & Associates, P.C.; Michael O. Scheinberg

(57) ABSTRACT

A wearable drum adapted to be strapped to a drummer's limb provides a resonance space between the drum head and the limb so that the drum produces a sound that is suitable to be heard by people other than the drummer.

5 Claims, 4 Drawing Sheets

(56) References Cited

U.S. PATENT DOCUMENTS

| | | | |
|---|---|---|---|
| 4,586,912 | A | 5/1986 | Adams |
| 4,648,603 | A | 3/1987 | Hayford |
| 4,733,808 | A | 3/1988 | Turner et al. |
| 4,821,932 | A | 4/1989 | Petryshyn |
| D308,983 | S | 7/1990 | Bonsor |
| D311,018 | S | 10/1990 | Corder |
| D316,090 | S | 4/1991 | Holloway et al. |
| D322,622 | S | 12/1991 | Gabriel et al. |
| 5,159,138 | A | 10/1992 | Kleinhans |
| 5,186,375 | A | 2/1993 | Plonk |
| 5,244,430 | A | 9/1993 | Legursky |
| D340,254 | S | 10/1993 | Yamashita |
| 5,562,521 | A | 10/1996 | Butler et al. |
| 5,607,091 | A | 3/1997 | Musacchia |
| D387,375 | S | 12/1997 | Bacco |
| 5,716,254 | A | 2/1998 | Bowes |
| 5,892,169 | A | 4/1999 | Shapiro |
| 5,932,823 | A | 8/1999 | Jacobs |
| 5,973,247 | A | 10/1999 | Matthews |
| 5,988,469 | A | 11/1999 | Musacchia |
| 5,998,716 | A | 12/1999 | Marquez et al. |
| 6,095,888 | A | 8/2000 | Panepinto |
| 6,239,340 | B1 | 5/2001 | Heuerman |
| 6,443,803 | B1 | 9/2002 | Epple |
| D464,078 | S | 10/2002 | Lau |
| D464,986 | S | 10/2002 | Hagiwara |
| 6,518,490 | B2 | 2/2003 | Good |
| D489,398 | S | 5/2004 | Pollock |
| 6,805,608 | B2 | 10/2004 | Forbes et al. |
| D507,589 | S | 7/2005 | Ito |
| 6,955,582 | B1 | 10/2005 | Forbes et al. |
| D521,845 | S | 5/2006 | Stevens et al. |
| D541,554 | S | 5/2007 | Maitland-S |
| 7,351,898 | B2 | 4/2008 | Sagastegui |
| D601,617 | S | 10/2009 | Cohen |
| 7,645,928 | B2 | 1/2010 | Graham et al. |
| 7,943,840 | B2 | 5/2011 | Yoshino et al. |
| D668,712 | S | 10/2012 | Gates |
| 8,283,544 | B2 | 10/2012 | Zuffante et al. |
| 8,629,339 | B1 | 1/2014 | Liao |
| D718,810 | S | 12/2014 | Marquez |
| 9,190,040 | B2 | 11/2015 | Hashimoto |
| D745,925 | S | 12/2015 | Mori |
| D747,229 | S | 1/2016 | Perez |
| 9,263,019 | B2 | 2/2016 | Dahl |
| D763,952 | S | 8/2016 | Turner |
| 2003/0029301 | A1 | 2/2003 | Belli |
| 2004/0154458 | A1 | 8/2004 | Coleman |
| 2006/0156898 | A1* | 7/2006 | Nickel ..... G10D 13/028 84/411 R |

FOREIGN PATENT DOCUMENTS

| | | | |
|---|---|---|---|
| DE | 9203292 | U1 | 5/1992 |
| FR | 20030070066 | A | 8/2003 |
| KR | 200440738 | | 6/2008 |
| TW | M452419 | U | 5/2013 |

OTHER PUBLICATIONS

Unknown, DW Drum Workshop SMPADSS Steve Smith Practice Kneepad, image post date May 29, 200, site visited Mar. 19, 2016, (online).

Unknown, Gibralter Knee Pad, image post date Feb. 9, 2008, site visited Mar. 19, 2016, (online).

Unknown, Training Pad Practice Pad Tpx6, image post dated Apr. 15, 2008, site visited Mar. 20, 2016, (online).

* cited by examiner

THIGH DRUM

This application is a divisional of U.S. Design patent application Ser. No. 29/502,889, filed Sep. 19, 2014, which is hereby incorporated by reference.

TECHNICAL FIELD OF THE INVENTION

The present invention relates to percussion instruments such as drums, and more particularly to drums which may be played while attached to a thigh of a percussionist.

BACKGROUND OF THE INVENTION

Percussion instruments such as drums are used in a wide range of musical organizations and situations, including clubs, concerts, dance halls, orchestras, and bands. Although the usage of drums for orchestras and bands which play in a (non-mobile) concert context will not typically require portability for the drum (or the other instruments in the band or orchestra), for a mobile context such as a marching band or military parade formation, the drum needs to be portable to enable the drummer to follow the motions of the overall group. Since drums come in a very wide size range, various methods have been developed to enable drums to move. The largest bass drums are commonly mounted on wheeled structures and pulled along either manually or using motors or engines. Smaller drums, such as "snare" drums, are typically supported by frames which fit over both shoulders of the drummer, wherein this mounting frame locates and supports the drum in a vertical position, i.e., with the drum surface horizontally-oriented at the top of the drum directly in front of the drummer. The weight of the drum as well as the mounting frame is then supported by the shoulders of the drummer.

For the mobile use of the smallest drums, this shoulder-mounted support method may be too expensive, heavy, bulky, or inconvenient. It would be preferred to have an alternative support and mounting method for smaller drums which is cheaper, simpler, less bulky, lighter in weight, and more convenient than the frame methods employed for snare drums.

Hand drums are designed to be held by a user and struck with the user's hand. Some are relatively large and supported by a floor stand. Other hand drums, such as the Remo World Wide Pretuned Hand Drum, from Remo Inc. of Valencia, Calif., and small and designed to be held by a user while drumming. There must be sufficient backing support for the drum so that when the drum is struck, the energy of the strike is primarily applied the drum head, causing it to vibrate, rather than causing the drum itself to move. Small hand drums can be played while the drummer is seated and supporting the drum.

Some drum practice pads, such as those described in U.S. Pat. No. 2,338,816; U.S. Pat. No. 4,406,207, and U.S. Pat. No. 8,629,339, include straps that are strapped to the user's thigh. Drum practice pads are not designed to provide a resonance chamber below the drum head to amplify the sound. The sound from a drum practice pad is intentionally muted. Thus, a practice pad is not suitable for use when playing in public with the intention of others hearing the drum.

SUMMARY OF THE INVENTION

An object of the invention is to provide a drum that can be strapped to a drummer's limb thereby enabling the drum to be played while the drummer is moving, for example, dancing, walking, marching, singing, or merely moving to music.

A drum includes a drum body having a wall, a drum head attached to the drum body; and an attachment strap attached to the drum body for affixing the thigh drum to a thigh of a drummer. A resonance space below the drum head and above the drummer's thigh allows the drum head to vibrate when struck and allows the vibrations to resonate in the hollow space.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION

The subject apparatus and methods are described in the context of representative embodiments that are not intended to be limiting in any way.

In the following description, certain terms may be used such as "up", "down", "upper", "lower", "horizontal", "vertical", "left", "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Embodiments of the invention can enable the use of a small hand drum in a mobile musical context such as while dancing, walking or marching band.

LISTING OF NUMBER CALLOUTS IN FIGURES

In FIGS. 1 through 8, the following number callouts are used:

100 a front perspective view of a thigh drum according to the present invention,

102 drum head,

104 attachment strap,

106 buckle,

108 decorative feature, not part of the present invention,

110 thigh cushion,

112 strap entrance hole,

120 drum body,

122 retaining ring,

124 thumb hole

126 arcuate cut-out

Figure 1:
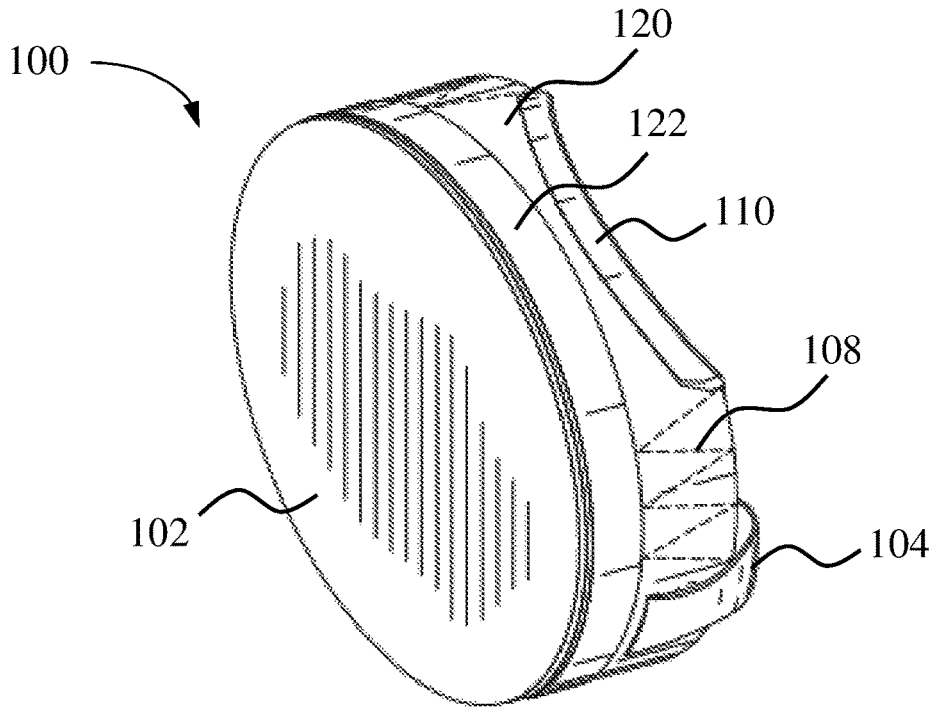
FIG. 1 is a front perspective view of a thigh drum according to the present invention.

200 a back perspective view of the thigh drum from FIG. 1,

300 a top plan view of the thigh drum from FIG. 1,

400 a bottom plan view of the thigh drum from FIG. 1,

500 an elevation view from the left side of the thigh drum from FIG. 1,

600 an elevation view from the right side of the thigh drum from FIG. 1,

700 a front elevation view of the thigh drum from FIG. 1,

800 a back elevation view of the thigh drum from FIG. 1.

Structural Elements of the Thigh Drum

Wearable practice pads are designed to be worn while seated and do not provide a resonance space below the drum head, and so the sound of a practice pad is muted. The present invention allows a drum to be worn by a drummer and still provides space for a resonance chamber below the drum head. The resonance chamber affects the volume and sound quality, and a drum of the present invention produces a sound that is typically a louder sound than a practice pad produces. The drum body includes arcuate cut-outs that are adapted to fit onto a drummer's thigh, and while still providing space between the thigh and the drum head for resonance.

The thigh drum comprises a drum body 120, to which a drum head 102 is affixed tightly and held taught by a retaining ring 122. To enable attachment of the thigh drum to a thigh of the drummer of the present invention, a retaining strap 104 is provided, which may be wrapped around the drummer's thigh and then buckled using buckle 106 or other fastener to hold the thigh drum firmly against wrapped around the thigh or other limb of the drummer. Because a firm attachment of the drum to the leg of the drummer is necessary to ensure that the drum maintains a desired position without slippage, even during repeated impacts of a hand or drumstick against the drum head, it is preferred that the strap 104 is pulled tight, thereby pulling the drum against the thigh of the drummer firmly, thus two thigh cushions 110 are provided to ensure that the surface of the thigh drum which is in contact with the thigh of the drummer is smooth and sufficiently soft to avoid irritation of the skin or muscles of the thigh even during extended wear of the drum and the repeated impact of a hand or drumstick against the drum head.

Figure 2:
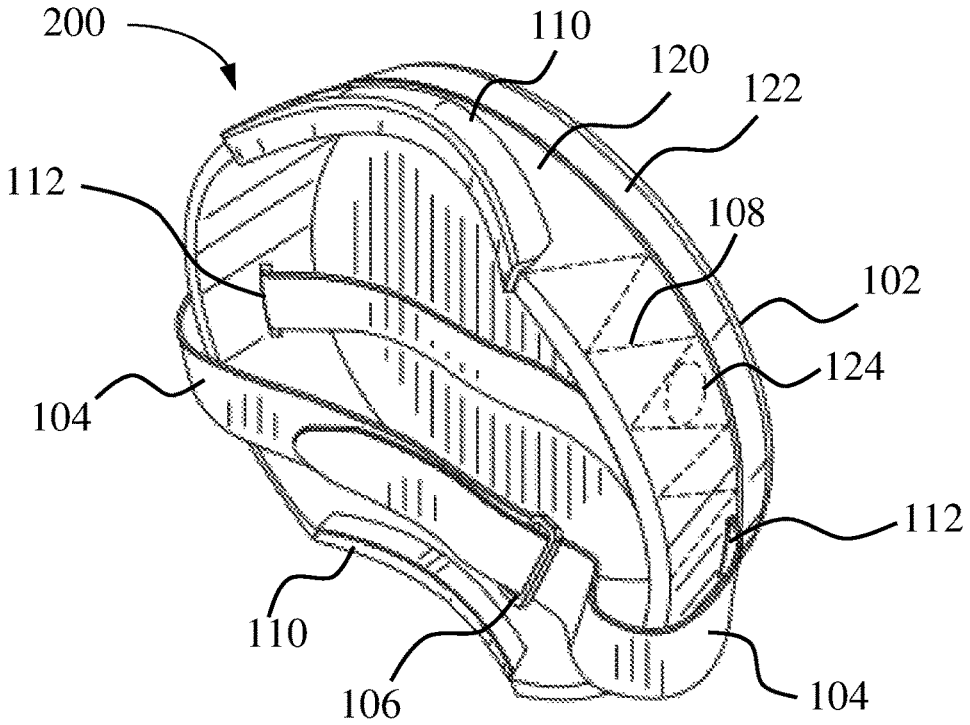
FIG. 2 is a back perspective view of the thigh drum from FIG. 1.
Figure 3:
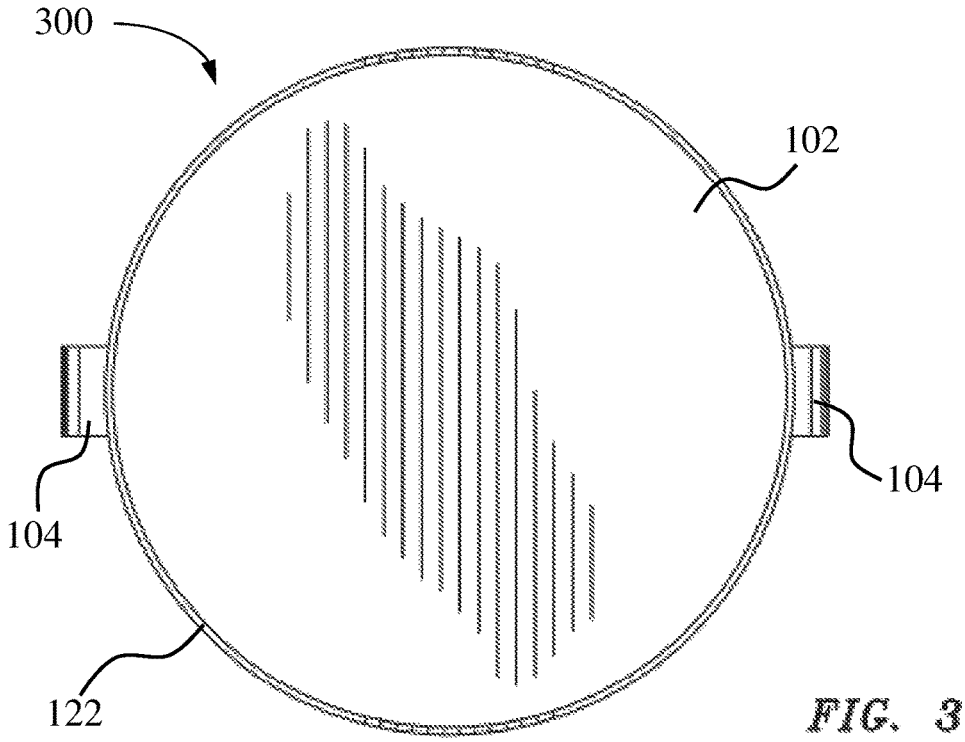
FIG. 3 is a top plan view of the thigh drum from FIG. 1.
Figure 4:
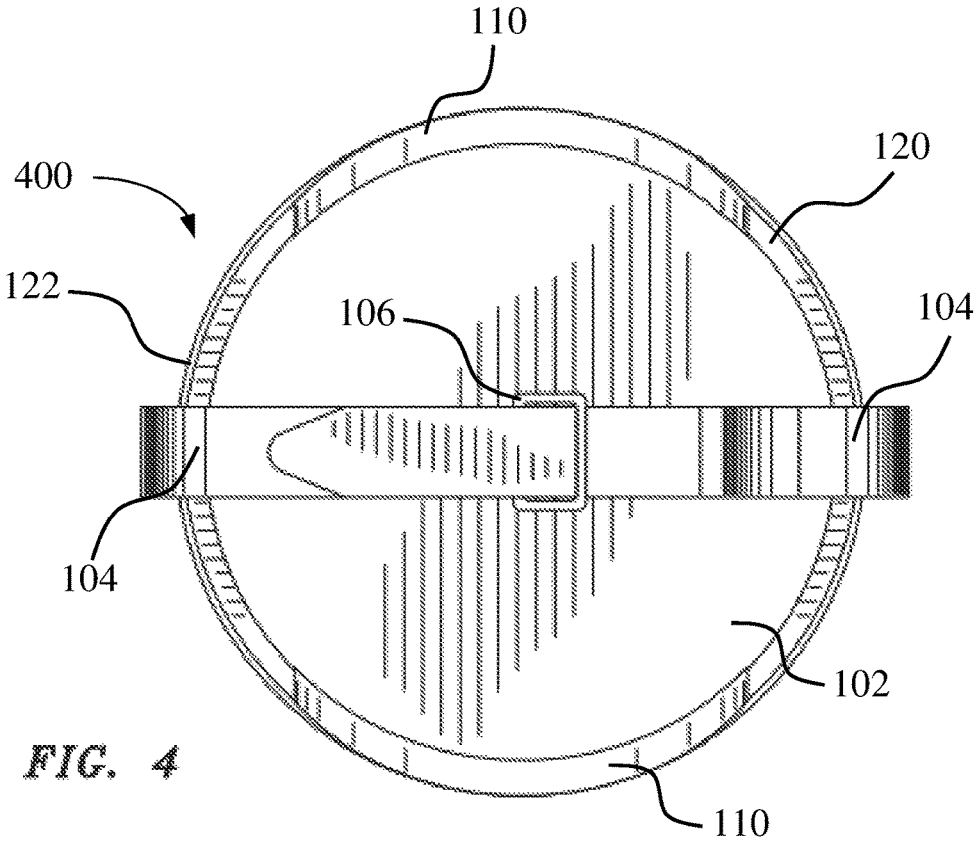
FIG. 4 is a bottom plan view of the thigh drum from FIG. 1.
Figure 5:
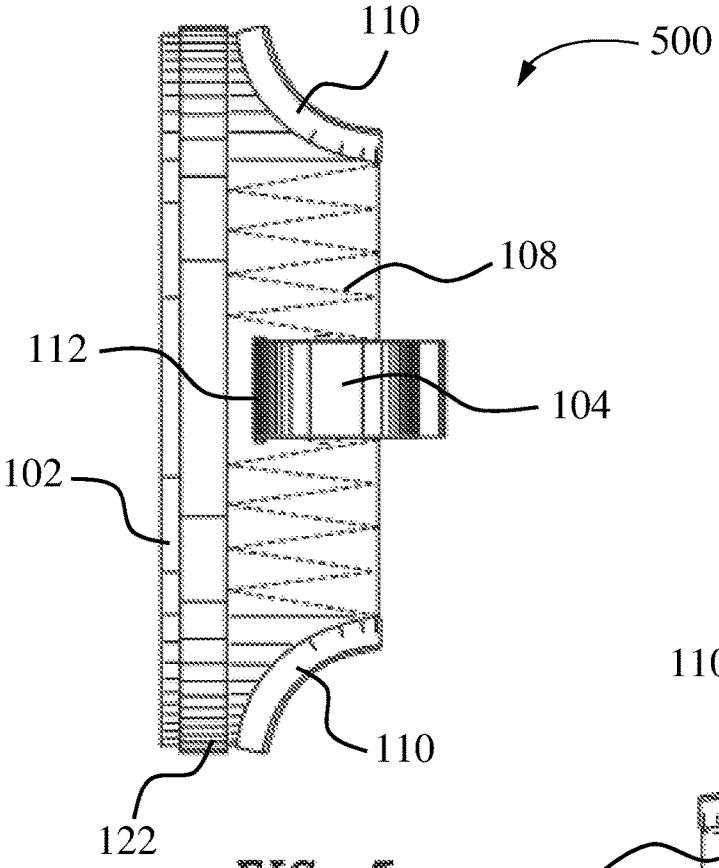
FIG. 5 is an elevation view from the left side of the thigh drum from FIG. 1.
Figure 6:
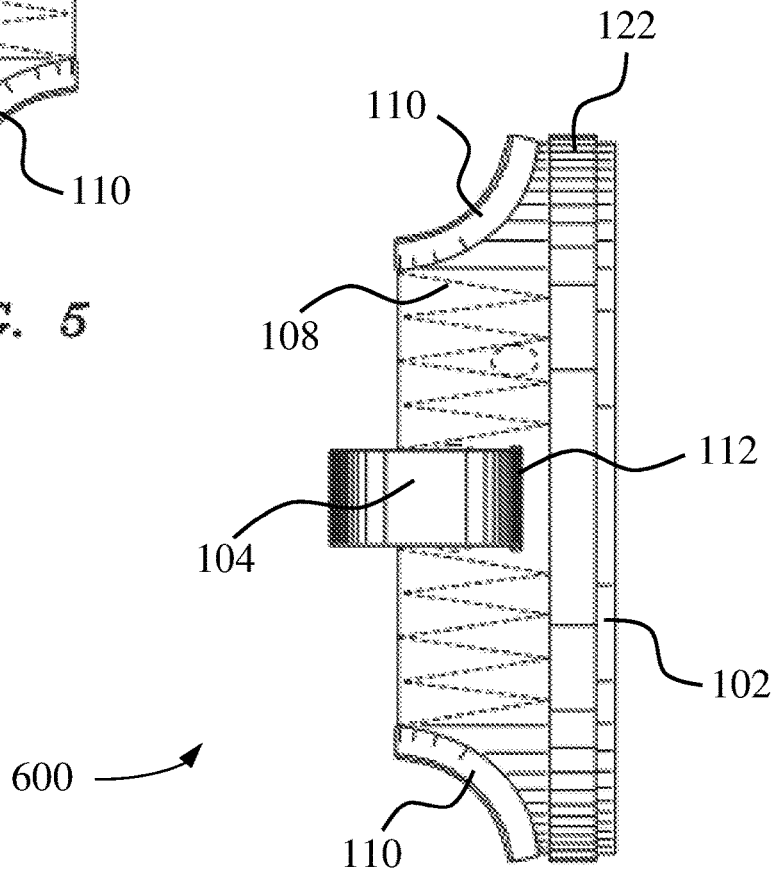
FIG. 6 is an elevation view from the right side of the thigh drum from FIG. 1.

The attachment strap 104 is shown in FIG. 2 to pass through a first hole 112 in a wall of the drum body 120 and then to pass across the diameter of the drum body 120, finally passing out through a second hole 112 in the opposite wall of the drum body. Alternative methods of mounting the attachment strap are possible within the scope of the invention. For example, attachment strap 104 could be attached to two locations approximately spaced 180° circumferentially around the wall of drum body 120, wherein the attachment locations could be approximately at the same locations as the two holes 112 shown in FIG. 2. An optional thumb hole 124 provides another way for the drummer to grasp the drum.

Figure 7:
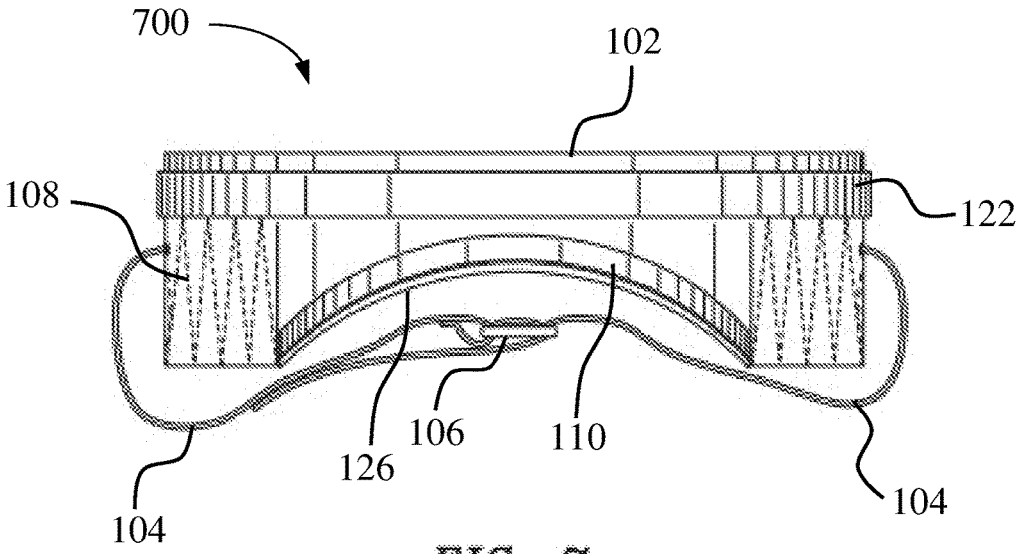
FIG. 7 is a front elevation view of the thigh drum from FIG. 1.
Figure 8:
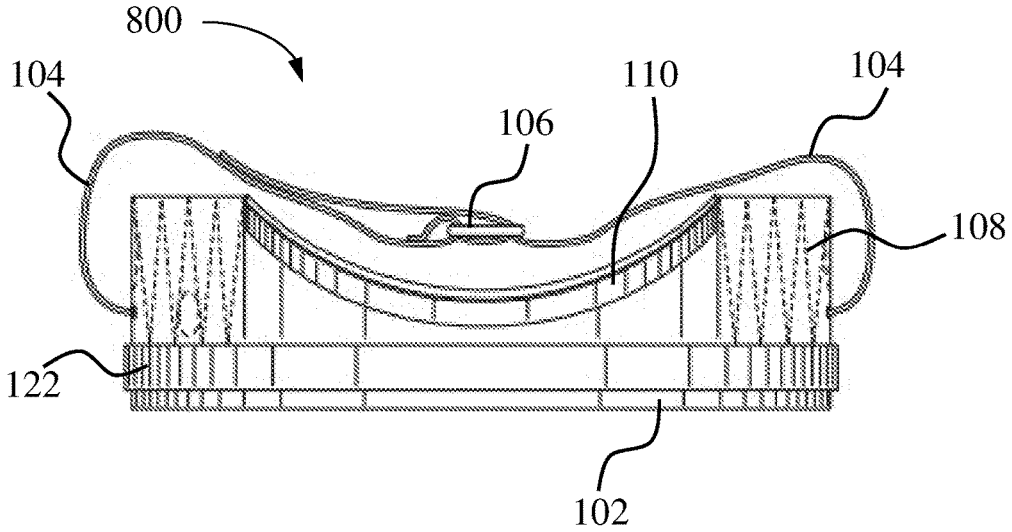
FIG. 8 is a back elevation view of the thigh drum from FIG. 1.

FIGS. 7 and 8 show front and back elevation views of the thigh drum of the present invention, further illustrating a possible curved shape of an arcuate cut-out 126 for the two thigh cushions 110—ideally this curved shape will approximate the curved shape of the thigh of a drummer for maximum comfort when wearing and using the thigh drum of the present invention. The curved shape of the thigh cushions may ensure that the thigh drum will remain in the correct orientation while worn and played. The radius of the curved thigh cushions may be determined by the curved shape of the thigh of an average drummer.

Although embodiments of the present invention and their advantages are described in detail above and below, it should be understood that the described embodiments are examples only, and that various changes, substitutions and alterations can be made herein without departing from the spirit and scope of the invention as defined by the appended claims. The scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention.

I claim as follows:

1. A thigh drum, comprising:

a drum body having a cylindrical wall;

a drum head attached to the drum body by a retaining ring; and an attachment strap for affixing the thigh drum to a thigh of a drummer;

in which the cylindrical wall includes arcuate cut-outs for conforming to a drummer's thigh and the cylindrical wall has sufficient height to create a resonance chamber between the drum head and the drummers' thigh position.

2. A thigh drum, comprising:

a drum body having a cylindrical wall;

a drum head attached to the drum body by a retaining ring; and an attachment strap for affixing the thigh drum to a thigh of a drummer, the drum body having two openings in the wall of the drum body enabling the attachment strap to pass through the wall of the drum body in which the cylindrical wall includes arcuate cut-outs for conforming to a drummer's thigh and the cylindrical wall has sufficient height to create a resonance chamber between the drum head and the drummers' thigh position.

3. The thigh drum of claim 2, wherein the attachment strap has a buckle to enable the attachment strap to be first wrapped around a thigh of a drummer, and then firmly tightened to the thigh.

4. A thigh drum, comprising:

a drum body having a cylindrical wall;

a drum head attached to the drum body by a retaining ring;

an attachment strap for affixing the thigh drum to a thigh of a drummer; and two curved thigh cushions located in the arcuate cut-outs such that the shape of the thigh cushions reduces shifting of the thigh drum during wearing and playing of the thigh drum, and improves comfort in which the cylindrical wall includes arcuate cut-outs for conforming to a drummer's thigh and the cylindrical wall has sufficient height to create a resonance chamber between the drum head and the plane of the cut-outs that define the drummers' thigh position.

5. The thigh drum of claim 4, wherein the radius of the curved thigh cushions may be determined by the curved shape of the thigh of an average drummer.

* * * * *